US008367154B2

(12) United States Patent
Yanagawa et al.

(10) Patent No.: US 8,367,154 B2
(45) Date of Patent: Feb. 5, 2013

(54) METHOD FOR COLORING ELECTRICAL WIRES

(75) Inventors: Naoki Yanagawa, Shizuoka (JP); Hiroaki Ichikawa, Shizuoka (JP); Masahiko Agata, Shizuoka (JP); Tatsuo Osada, Shizuoka (JP); Kenji Kinezuka, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 743 days.

(21) Appl. No.: 12/086,181

(22) PCT Filed: Nov. 8, 2006

(86) PCT No.: PCT/JP2006/322696

§ 371 (c)(1),
(2), (4) Date: May 19, 2009

(87) PCT Pub. No.: WO2007/066476

PCT Pub. Date: Jun. 14, 2007

(65) Prior Publication Data

US 2009/0304913 A1 Dec. 10, 2009

(30) Foreign Application Priority Data

Dec. 8, 2005 (JP) ..... 2005-354370
Apr. 20, 2006 (JP) ..... 2006-116544

(51) Int. Cl.
*B05D 5/12* (2006.01)

(52) U.S. Cl. ..... 427/117; 427/118

(58) Field of Classification Search ..... 427/117, 427/118

See application file for complete search history.

(56) References Cited

U.S. PATENT DOCUMENTS

| | | | | |
|---|---|---|---|---|
| 1,944,823 | A * | 1/1934 | Lament | 427/118 |
| 3,343,981 | A * | 9/1967 | Lenkei | 427/117 |
| 5,024,864 | A * | 6/1991 | Bleich et al. | 427/424 |
| 5,866,195 | A * | 2/1999 | Lemelson | 427/62 |
| 7,718,217 | B2 * | 5/2010 | Kamata et al. | 427/117 |
| 8,017,177 | B2 * | 9/2011 | Kamata et al. | 427/117 |

FOREIGN PATENT DOCUMENTS

| | | |
|---|---|---|
| DE | 32 19 569 | 12/1983 |
| GB | 1 275 714 | 5/1972 |
| GB | 1275714 | * 5/1972 |
| JP | 11-027817 | 1/1999 |
| JP | 2004-079200 | 3/2004 |

OTHER PUBLICATIONS

Written Opinion of the International Searching Authority Feb. 1, 2007.

International Search Report dated Feb. 1, 2007, issued in PCT/JP2006/322696.

International Preliminary Report on Patentability dated Dec. 27, 2007.

* cited by examiner

*Primary Examiner* — Brian K Talbot

(74) *Attorney, Agent, or Firm* — Edwards Wildman Palmer LLP; James E. Armstrong, IV; Stephen D. LeBarron

(57) ABSTRACT

The present invention is to provide an apparatus for coloring an electrical wire to improve a visibility and design of the electrical wire. The apparatus includes a coloring device for ejecting a liquid coloring material to an outer surface of the electrical wire and a sliding device for moving relatively the coloring device in a direction perpendicular to a longitudinal direction of the electrical wire so as to color each whole outer surface of a plurality of coloring regions thereof responsive to a belt-shaped design pattern.

7 Claims, 13 Drawing Sheets

METHOD FOR COLORING ELECTRICAL WIRES

TECHNICAL FIELD

The present invention relates to an apparatus and method for coloring an electrical wire having a core wire and an insulating cover.

RELATED ART

A motor vehicle has a variety of electronic devices. Electrical power from an electric supply and a control signal from a computer are provided to the electronic devices via a wire harness, which has a plurality of the electrical wires and connectors attached to ends thereof.

The electrical wire has a conductive core wire and an insulating cover made of a synthetic resin covering the core wire. The connector has a conductive terminal and an insulated connector housing. The terminal is attached to an end of the electrical wire and electrically connected with the core wire. The connector housing has a box shape and receives the terminal.

For assembling the wire harness, the electrical wire is cut into a prescribed length and the terminal is attached to the end thereof. The terminal is then inserted into the connector housing to assemble the wire harness.

The wire harness is identified with a diameter of the core wire, property of the insulating cover (heat resistant or not), and purpose of use. The purpose of use is classified into a use for the control signal such as air bag, ABS (Antilock Brake System), running speed, and a use for a system such as power transmission.

The electrical wire of the wire harness is identified with a stripe pattern of two colors on an outer surface of the electrical wire. The core wire is covered with the synthetic resin containing a desired coloring agent. The covered core wire is then marked with the stripe pattern with a different color on a part of the outer surface thereof.

A kind of the electrical wire at manufacturing thereof is identified with the color of the stripe pattern. The stripe pattern however does not provide enough recognition from a certain direction. The applicant of the present invention discloses in JP,2004-79200,A that an electrical wire covered with a single color synthetic resin is spirally colored with a coloring material to an outer surface of the electrical wire along an axis thereof.

A plurality of dots spirally formed around the electrical wire provide an easy recognition of the kind thereof from any directions against the electrical wire. A single color (mark) is, however, not enough for controlling the increasing number of the electrical wires. A plurality of colors are thus utilized for the spiral coloring but the recognition of the pattern is not enough from a certain direction.

DISCLOSURE OF THE INVENTION

An object of the present invention is to provide an apparatus and method for coloring an electrical wire to improve visibility and design thereof.

According to a first aspect of the present invention, as shown in FIG. 1, an apparatus 1 for coloring outer surfaces 3*a* of a plurality of electrical wires 3 includes a coloring device 13 for ejecting a liquid coloring material to the outer surface 3*a* of the respective electrical wires 3; a sliding device 14 or 15 for moving relatively the coloring device 13 in a direction perpendicular to a longitudinal direction of the electrical wires 3 so as to color each whole outer surface 3*a* of a plurality of coloring regions 3*b* thereof responsive to a belt-shaped design pattern 6; and a conveyer apparatus for intermittently moving the plurality of the electrical wires 3.

Preferably, the apparatus 1 further includes a moving control device 21*a* for requesting the sliding device 14 or 15 to move, toward another coloring region 3*b*, relatively the coloring device 13 against the electrical wires 3 arranged in parallel, after the moving control device 21*a* requests for the sliding device 14 or 15 to move relatively the coloring device 13 in the direction perpendicular to the longitudinal direction of the electrical wires 3 over a same colored coloring region 3*b* of the plurality of the electrical wires 3.

Preferably, the apparatus 1 further includes a conveyer apparatus 10 for intermittently moving the plurality of the electrical wires 3, wherein the conveyer apparatus 10 moves the plurality of the electrical wires 3 by a prescribed distance after the coloring device 13 colors the coloring region 3*b* with the same color when the conveyer apparatus 10 is quiescence and the sliding device 14 or 15 moves the coloring device 13 to a stopping position, and the sliding device 14 or 15 moves the coloring device 13 to a next starting position.

Preferably, the apparatus 1 further includes a coloring control device 21*b* for controlling the coloring device 13 to eject the coloring material in an adhering region where the coloring material adheres the whole outer surface 3*a* of the electrical wire 3.

According to a second aspect of the present invention, an apparatus 1 for coloring an outer surface 3*a* of an electrical wire 3 includes a plurality of coloring devices 13 disposed radially around the electrical wire 3 for ejecting liquid coloring materials to the outer surface 3*a* of the electrical wire 3; a sliding device 14 or 15 for moving the plurality of the coloring devices 13 in a longitudinal direction of the electrical wire 3 so as to color each whole outer surface 3*a* of a plurality of coloring regions 3*b* thereof responsive to a belt-shaped design pattern 6; and a coloring control device 21*b* for controlling the plurality of the coloring devices 13 to eject the coloring materials in an adhering region where the coloring materials adhere the whole outer surface 3*a* of the electrical wire 3.

According to a third aspect of the present invention, an apparatus 1 for coloring an outer surface 3*a* of an electrical wire 3 includes: a coloring device 13 having a coloring nozzle, which is wider than a width of the electrical wire 3, for ejecting a coloring material to the outer surface 3*a* of the electrical wire 3; a sliding device 14 or 15 for moving the coloring device 13 in a longitudinal direction of the electrical wire 3 so as to color each whole outer surface 3*a* of a plurality of coloring regions 3*b* thereof responsive to a belt-shaped design pattern 6; and a coloring control device 21*b* for controlling the coloring device 13 to eject the coloring material in an adhering region where the coloring material adheres the whole outer surface 3*a* of the electrical wire 3.

According to a fourth aspect of the present invention, as shown in FIG. 2, an apparatus 1 for coloring an outer surface 3*a* of an electrical wire 3 includes: a coloring device 13 for ejecting a liquid coloring material to the outer surface 3*a* of the electrical wire 3; a mask 70 disposed between the coloring device 13 and the electrical wire 3 for regulating the coloring material ejected from the coloring device 13 so as to form a design pattern 6 on the outer surface 3*a* of the electrical wire 3; and a sliding device 14 for moving the coloring device 13 in a longitudinal direction of the electrical wire 3 with respect to the mask 70.

Preferably, the coloring device 13 ejects the coloring material to the outer surface 3*a* of the electrical wire 3 held with a holder.

According to a fifth aspect of the present invention, a method of coloring outer surfaces 3*a* of electrical wires 3 includes the steps of: ejecting a liquid coloring material to the outer surface 3*a* of the respective electrical wire 3; coloring each whole outer surface 3*a* of a plurality of coloring regions 3*b* thereof responsive to a belt-shaped design pattern 6; and moving intermittently the plurality of the electrical wires 3, wherein a coloring device 13 for ejecting the coloring material is moved relatively against the electrical wires 3 in a direction perpendicular to a longitudinal direction of the electrical wires 3.

BEST MODE FOR CARRYING OUT THE INVENTION

Embodiments of an apparatus for coloring an electrical wire, hereafter referred to coloring apparatus, of the present invention are explained by referring to FIGS. 3-18.

Figure 1:
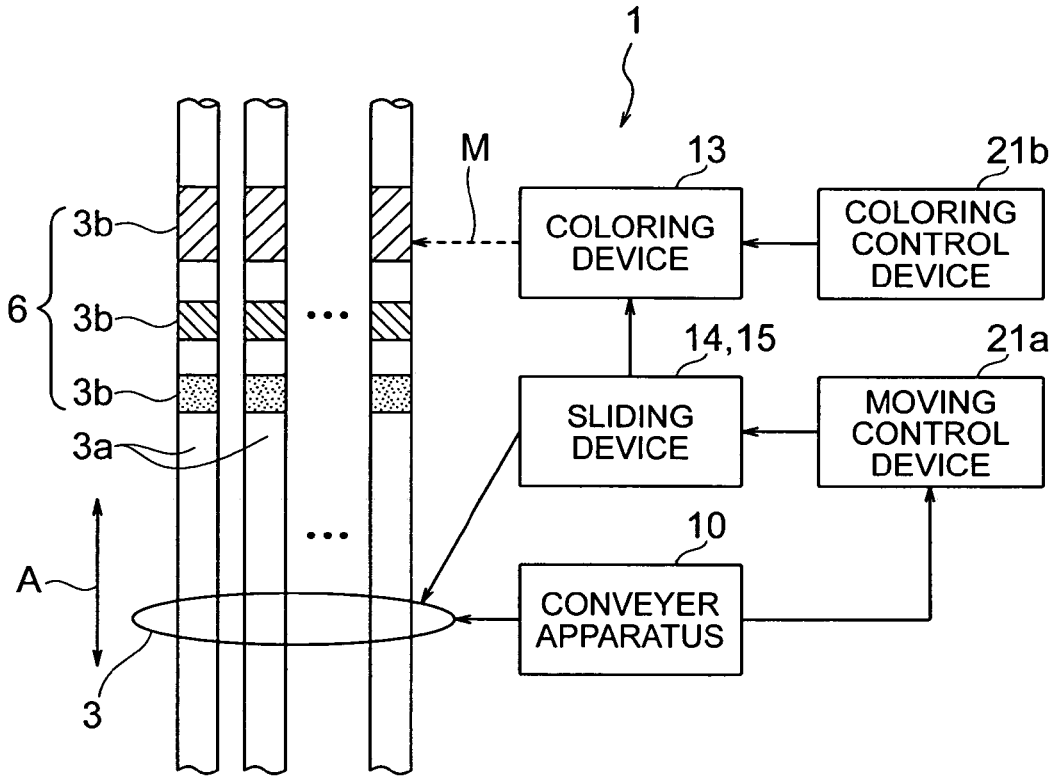
FIG. 1 shows a first basic configuration of an apparatus for coloring an electrical wire (coloring apparatus) of the present invention.
Figure 2:
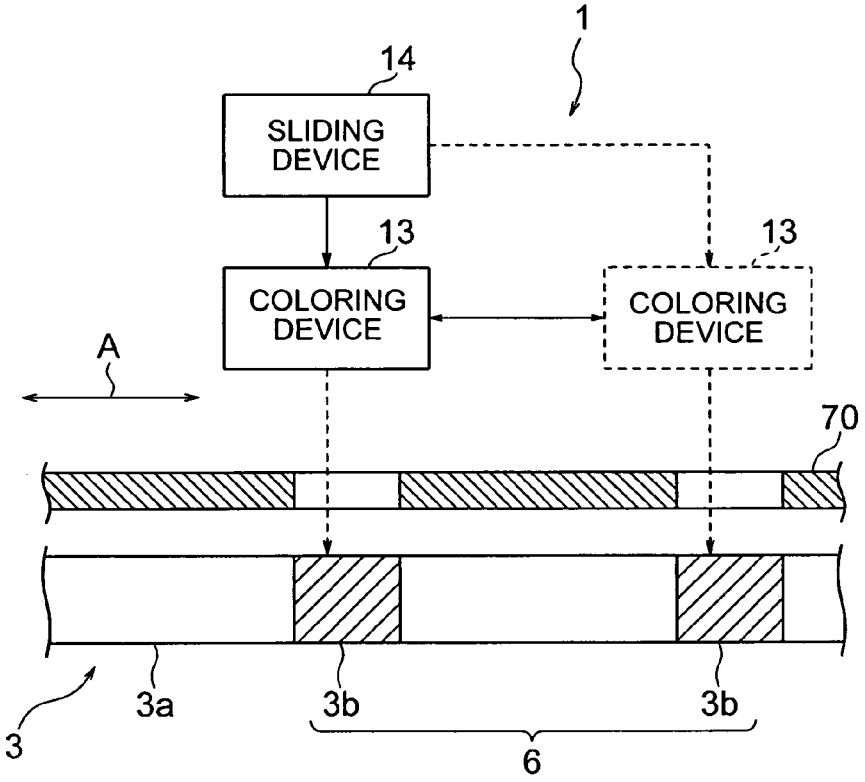
FIG. 2 shows a second basic configuration of a coloring apparatus of the present invention.
Figure 3:
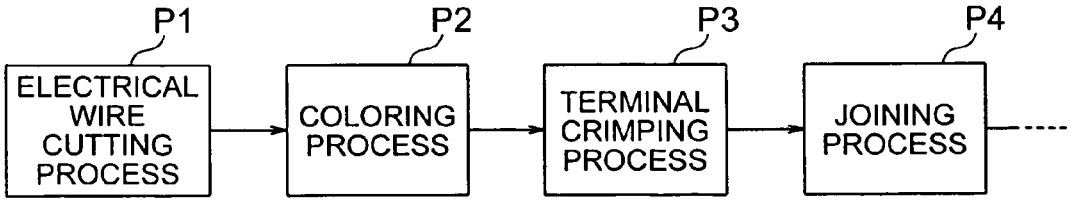
FIG. 3 shows a process for manufacturing a wire harness utilized with the coloring apparatus of the present invention.

A system for manufacturing a wire harness includes an electrical wire cutting process P1, a coloring process P2, a terminal crimping process P3, and a joining process P4, as shown in FIG. 3. The coloring apparatus is arranged in the coloring process P2. When the system does not have the coloring process P2, the coloring apparatus can be arranged in the cutting process P1 or the crimping process P3.

The wire harness has a plurality of sub-wire harnesses utilized for devices mounted in a motor vehicle. Each sub-wire harness has a plurality of electrical wires and a connector disposed at an end of the electrical wire.

The electrical wire cutting process P1 includes selection, measurement, and cutting of the electrical wire. The wire cutting process P1 has an electrical wire manufacturing apparatus 100 of FIG. 4.

The electrical wire manufacturing apparatus 100 cuts the electrical wire wound in a reel into a prescribed length and forms the electrical wire into a U-shape and locks the ends thereof with clamping rods to forward the following processes. The clamped electrical wire is then conveyed to the coloring process P2 with a conveyer apparatus 10.

The conveyer apparatus 10 has a conveyer belt or chain moving through the processes described above, a conveyer motor for driving the belt, and a conveyer controller. The clamping rod is conveyed to the following process with the motor controlled with the controller. The conveyer controller intermittently conveys the plurality of the electrical wires corresponding to a cycle (tact time) of crimping at the terminal crimping process. The conveyer apparatus 10 thus achieves an electrical wire conveyer means.

The clamping rod (not shown) has a plurality of holders 11 and fixing portions for fixing the holders 11 with a prescribed distance. The electrical wire manufacturing apparatus 100 forms the electrical wire into the U-shape with a U-turn bending head to be held with a pair of the holders 11.

In the coloring process P2, a liquid coloring material adheres on an outer surface of the electrical wire conveyed from the electrical wire cutting process P1 to form a belt-shaped design pattern which identifies the electrical wire. The coloring process P2 includes a coloring apparatus 1 of the present invention.

The terminal crimping process P3 includes sorting, setting of applicator (A/P), crimping, testing, and marking of the electrical wire. The terminal crimping process P3 sorts the electrical wire about kinds of terminals. The setting of applicator (A/P) includes a change of a terminal crimping apparatus 200 depending on the kind of the terminal, and an adjustment of height thereof. The applicator A/P has a crimper and an anvil. The crimper moves vertically and is placed above the anvil. After crimping the terminal at the end of the electrical wire, a crimping state is tested with eyes or a TV camera and the terminal is marked with a marking pen for identifying the terminal at a following terminal inserting process.

The terminal crimping apparatus 200 crimps different kinds of terminals and are well known in the art. The crimping apparatus 200 crimps the electrical wire, which is held with the clamping rod and conveyed, with the crimping device described above.

The joining process P4 includes separation, stripping, setting of an applicator (A/P), joining crimping, testing, and taping. The joining process P4 sorts the electrical wire with the terminal depending on the kind of joint terminals and joining position thereof.

An insulating cover is removed from a middle portion of the electrical wire with a stripper. The applicator (A/P) of the joint crimper is set in accord with the joint terminal. Another terminal is connected to the stripped portion for a branch connection. After testing the crimping state, the joint portion is taped with a insulating vinyl tape.

After the terminal crimping process P3 or the joining process P4, the electrical wire is classified into a part number.

Then, each terminal of the electrical wire is inserted into a connector housing to assemble the sub-wire harness of the wire harness.

EXAMPLE 1

Figure 4:
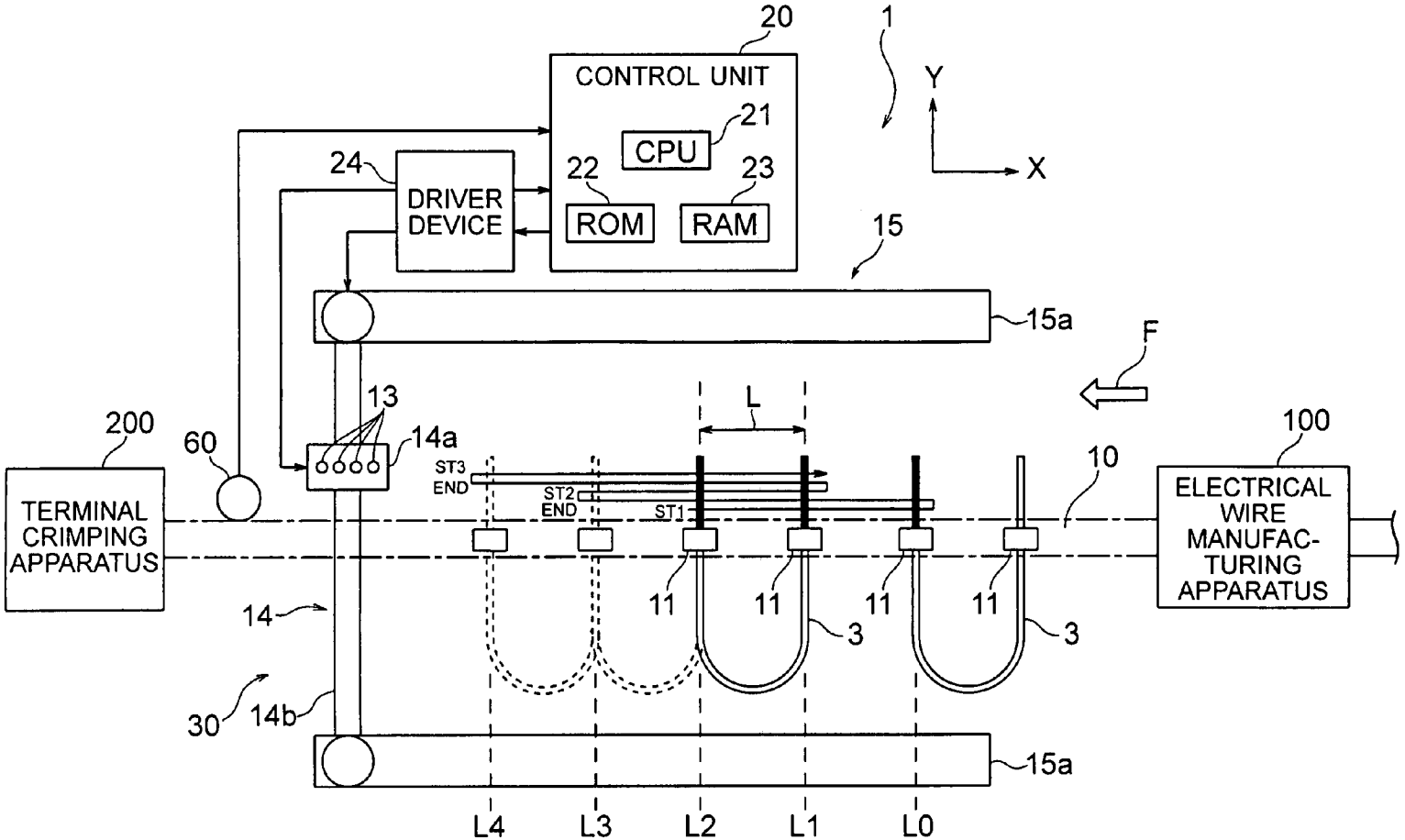
FIG. 4 shows a configuration of a first embodiment of the coloring apparatus of the present invention.

FIG. 4 shows a first embodiment of the coloring apparatus 1 of the present invention. The coloring apparatus 1 is arranged in the coloring process P2 and forms a belt-shaped design pattern 6, refer to FIG. 5, on a part of an outer surface 3*a* of an electrical wire 3 with a liquid coloring material.

Figure 5:
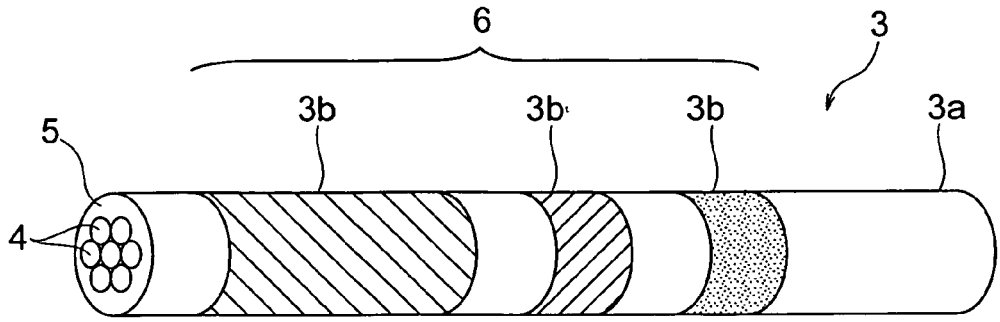
FIG. 5 shows a design pattern to be formed on an outer surface of the electrical wire.

The wire harness arranged in the motor vehicle has the electrical wire 3. As shown in FIG. 5, the electrical wire 3 has a conductive core wire 4 and an insulating cover 5. The conductive core wire 4 has a plurality of conductive wires twisted together and formed with a conductive metal. The core wire 4 may have a single conductive wire. The insulating cover 5 is made of a synthetic resin such as a polyvinylchloride (PVC) and covers the core wire 4. The outer surface 3*a* of the electrical wire 3 is an outer surface 3*a* of the insulating cover 5.

The insulating cover 5 has a single color and can be colored by adding a desired coloring agent to the synthetic resin forming the insulating cover 5.

The electrical wires 3 are bundled and the end portions thereof are connected to the connector to form the wire harness. The connector is connected to a connector of various types of electronic devices of the motor vehicle for providing several signals and electrical power.

A plurality of coloring regions 3*b* corresponding to the design pattern 6 are formed on the outer surface 3*a* of the electrical wire 3 with the coloring materials. The coloring materials adhere to upper surfaces of the coloring regions 3*b* and flow to rear sides so as to adhere around the coloring regions 3*b*. In the embodiment, the coloring regions 3*b* have different widths along a longitudinal direction of the electrical wire 3 but can be formed with a same width.

The design pattern 6 has a combination of the widths, a number, and colors of the coloring regions 3*b* so as to define colors, sizes and purposes of use of the electrical wires 3. The design pattern 6 is also capable showing an information about a product class and a system line of the electrical wire.

The design pattern 6 is formed in a ring shape covering the whole outer surface 3*a* of the electrical wire 3 for the identification of the electrical wire 3. It is thus not necessary to manufacture the electrical wire 3 having white color and to mark the band mark thereon for identifying the electrical wire 3.

Referring to FIG. 4, the coloring apparatus 1 of the electrical wire 3 includes a control unit 20, a coloring unit 30, a driver device 24 for driving the coloring unit 30, and a transfer sensor 60.

The control unit 20 has a central processing unit (CPU) 21 for achieving several controls or processes responsive to a prescribed program, a ROM (Read-only Memory) 22 for storing the program achieved with the CPU 21, and a RAM (Random Access Memory) 23 for storing several data and providing a working area for the CPU 21.

The ROM 22 has a coloring control device 21*a* and a moving control device 21*b* as the programs which the CPU 21 executes.

The ROM 22 also stores an information about the plurality of design patterns responsive to the colors and sizes of the electrical wires 3. The design pattern information includes the information about the coloring regions 3*b*, the coloring materials, and ejection-starting positions of the coloring regions 3*b*.

The driver device 24 is connected to the control unit 20 and the coloring unit 30 for controlling the ejection and movement of coloring devices 13, and outputs a positioning information, such as a value of a counter responsive to the position of the moving coloring device 13, to the control unit 20.

The coloring unit 30 includes the plurality of the coloring devices 13 responsive to the colors of the coloring materials, four in FIG. 4, a case 14*a* receiving the coloring devices 13, a first sliding device 14 for moving the case 14*a* in a direction Y, and a second sliding device 15 for moving the sliding device 14 in a direction X.

The plurality of the coloring devices 13 are arranged along a conveyer direction F of the electrical wire 3 and each include a coloring nozzle 31, a coloring material supplier 32, and a pressurized gas supplier 33. In the embodiment of the present invention, the plurality of the coloring devices 13 are arranged in line along the conveyer direction F but other modifications such as a plural lines are also possible.

The coloring nozzles 31 eject the coloring materials from the suppliers 32 onto the outer surface 3*a* of the electrical wire 3 to color or mark at least a part of the outer surface 3*a*.

Figure 7:
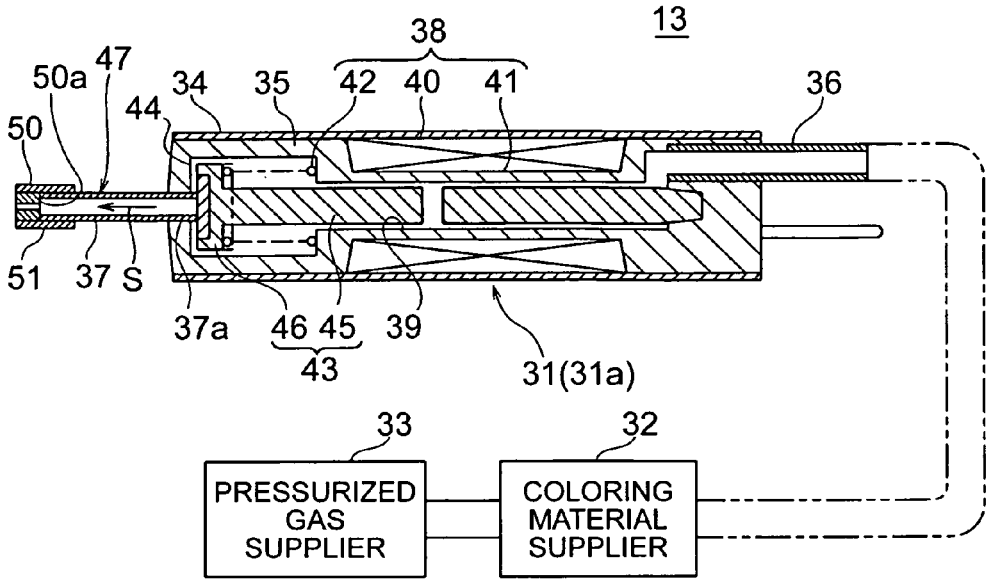
FIG. 7 is a sectional view of a coloring nozzle of a coloring unit of FIG. 4.

The coloring nozzle 31 of FIG. 7 includes a cylindrical main body 34, an insertion member 35 received in the main body 34, a conduit 36, a first nozzle member 37, a valve device 38, a second nozzle member 50, and a connecting tube 51.

The second nozzle member 50 has a tubular shape and is formed with Polyetheretherketone (PEEK) and has an outer diameter same as an outer diameter of the first nozzle member 37. The second nozzle member 50 has an inner diameter smaller than that of the first nozzle member 37 and is disposed coaxially with the first nozzle member 37 and connected thereto. The second nozzle member 50 is arranged closer to the electrical wire 3 than the first nozzle member 37. A contact portion between the first and second nozzle members 37 and 50 is kept water tight. The coloring material flows in a direction noted as an arrow S. The second nozzle member 50 has a flat end face 50*a*, which projects inwardly and intersects with the arrow S.

The first and second nozzle members 37 and 50 configure a nozzle member 47, which is connected inside the insertion member 35 for allowing the coloring material to flow.

The connecting tube 51 is made of a fluorine resin and formed in a cylindrical shape. The connecting tube 51 detachably connects the first nozzle member 37 with the second nozzle member 50.

Each coloring device 13 is connected to the control unit 20 and controlled with the control unit 20. When a coil is not energized, a valve 44 contacts an end 37*a* of the first nozzle member 37 with an urging force of a coil spring 42 so that the coloring material is remained in a passage 39.

When the coil 40 is energized, the valve 44 attached to a circular disk 46 separates from the end 37*a* against the urging force and allows the coloring material to flow in the passage 39 in the direction S and the coloring nozzle 31 ejects the coloring material through the second nozzle member 50. The coil 40 is energized for a prescribed period of time in accord with a request from the driver device 24 so that the coloring nozzle 31 ejects a prescribed amount of the coloring material onto the outer surface 3*a* of the electrical wire 3.

The coloring material is a liquid material consisting of color material (organic substance for industrial use) dissolved or dispersed in water or other solvent. The organic substance or the coloring material is dyes and pigments. The pigments are mainly organic substances and synthetic product. The dyes may be used as the pigments, or the pigments may be used as the dyes according to cases. As more specific examples, the coloring material means both coloring liquid and paint.

The coloring liquid means the dye dissolved or dispersed in the solvent, while the paint means the pigment dispersed in dispersion liquid. Thus, when the coloring liquid is adhered to the outer surface 3*a* of the electrical wire 3, the dye is infiltrated into the insulating cover 5. On the other hand, when the paint is adhered to the outer surface 3*a* of the electrical wire 3, the pigment is not infiltrated into the insulating cover 5, but simply adhered to the outer surface 3*a* thereof. In other words, the coloring devices 13 serve to dye the part of the outer surface 3*a* of the electrical wire 3 with the dye, or alternatively, to apply the pigment to the part of the outer surface 3*a* of the electrical wire 3. Therefore, the method for marking the outer surface 3*a* of the electrical wire 3 includes both dyeing the part of the outer surface 3*a* of the electrical wire with the dye, and applying the pigment to the part of the outer surface 3*a* of the electrical wire 3.

It is desired that the solvent and dispersion liquid are compatible with the synthetic resin which forms the insulating cover 5. In this case, the dye can be reliably infiltrated into the insulating cover 5, and the pigment can be reliably adhered to the outer surface 3*a* of the insulating cover 5.

In the embodiment of the present invention, the coloring material utilizes the coloring liquid described above with acetone for solvent.

Each coloring material supplier 32 receives the coloring material and supplies the coloring material to the conduit 36 of the corresponding coloring nozzle 31.

Each pressurized gas supplier 33 supplies the pressurized gas to the coloring material supplier 32 so that the valve 44 is detached from the end 37*a* of the first nozzle member 37 and the coloring material in the passage 39 is ejected from the second nozzle member 50.

Each coloring device 13 can vary the pressure of the pressurized gas supplier 33, a nozzle diameter of the coloring nozzle 31, a flowing speed of the coloring material in the nozzle, a distance between the coloring nozzle 31 and the electrical wire 3, and a viscosity of the coloring material so that the width of the coloring region 3*b* and an encirclement of the coloring material around the electrical wire 3 can be controlled effectively for forming the desired design pattern 6.

The first sliding device 14 is connected to the driver device 24 which controls a driving motor. The driving motor drives the case 14*a* to a prescribed position along a rectangular-shaped rail 14*b* disposed in the direction Y. The control unit 20 controls the position of the case 14*a* in the vertical or direction Y in FIG. 4. The first sliding device 14 holds the coloring nozzles 31 of the coloring devices 13 vertical to the electrical wire 3 and moves the coloring nozzles 31 along the rail 14*b*.

The second sliding device 15 has a pair of guides 15*a* disposed parallel and opposed to each other with respect to the conveyer apparatus 10. The pair of the guides 15*a* have driving mechanisms for moving the rail 14*b* along the direction X and driving motors for driving the driving mechanisms with the control unit 20. The second sliding device 15 arranges the coloring nozzles 31 to eject the coloring materials perpendicularly to the plurality of electrical wires 3 and moves the case 14*a* between L0-L4 in the direction X of FIG. 4.

Each coloring device 13 ejects the respective coloring material perpendicularly to the electrical wire 3 with the aid of the first and second sliding devices 14 and 15. When the coloring device 13 is moved in a direction perpendicular to a longitudinal direction of the electrical wire 3, the coloring material encircles and adheres a whole outer surface 3*a* of the electrical wire 3.

The control unit 20 selects the coloring device 13 responsive to the color of the coloring region 3*b*, and requests the driver device 24 to move the coloring device 13 with the first and second sliding devices 14, 15 in the directions X and Y of FIG. 4 and to eject the coloring material. In this embodiment, the driver device 24 is utilized but the control unit 20 can directly control the coloring devices 13 and the first and second sliding devices 14, 15 without the driver device 24.

Figure 6:
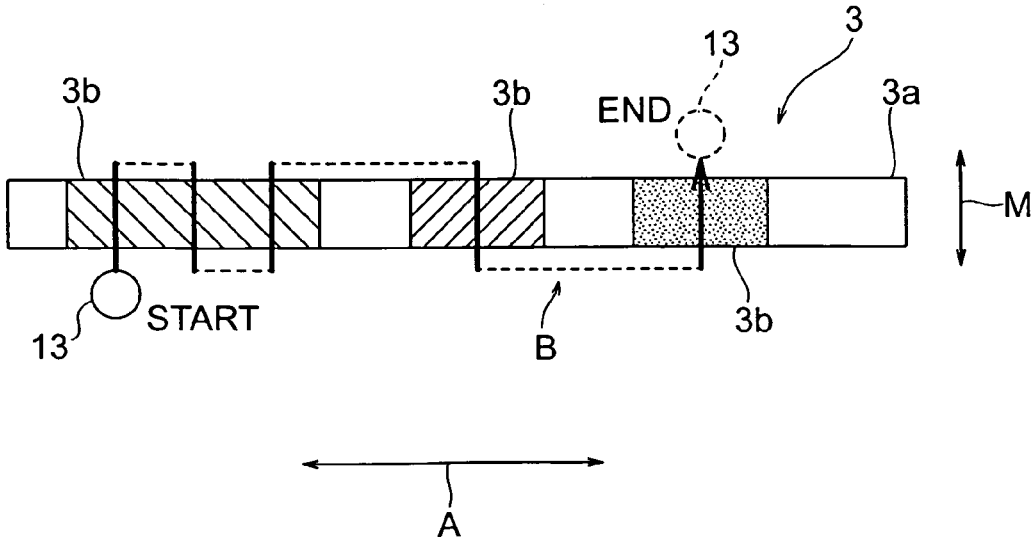
FIG. 6 shows a movement of a coloring device for forming the design pattern of FIG. 5.

When the design pattern 6 of FIG. 5 is formed on the outer surface 3*a* of the fixed electrical wire 3, the coloring device 13 is moved from START to END along solid lines and dotted lines in a direction of an arrow B of FIG. 6. When each coloring device 13 passes over the electrical wire 3 in a direction M, the coloring device 13 ejects the coloring material to the electrical wire 3 through the coloring nozzle 31 to form each respective coloring region 3*b* and is moved along a longitudinal direction A of the electrical wire 3.

Figure 8:
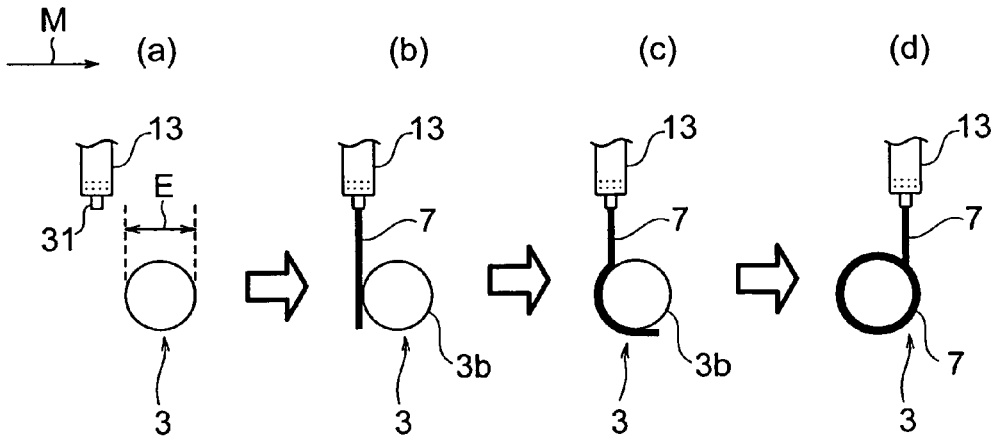
FIG. 8 illustrates a process for coloring the electrical wire with a coloring material ejected from the coloring nozzle, where (a) prior to adhering of the coloring material, (b) start of ejection of the coloring material, (c) start of encircling of the coloring material, and (d) completion of coloring of the electrical wire.

FIG. 8 shows an example operation of coloring the electrical wire 3 with the coloring material. The coloring device 13 does not eject the coloring material 7 at a position, refer to step (a), where the ejected coloring material 7 does not adhere to the whole outer surface 3*a* of the respective coloring region 3*b*. When the coloring device 13 comes to a region (adhering region E), refer to step (b), where the ejected coloring material adheres to the whole outer surface 3*a* of the electrical wire 3, the coloring device 13 starts to eject the coloring material 7.

In step (c), the coloring device 13 is moved to the direction M and the coloring material 7 encircles the coloring region 3*b*. When the coloring device 13 passes over the electrical wire 3, step (d), the coloring material 7 is adhered to the whole surface 3*a* of the coloring region 3*b* of the electrical wire 3.

The transfer sensor 60 has a rotor and an encoder, both not shown. The rotor rotates responsive to the movement of the conveyer apparatus 10 and the encoder is connected to the control unit 20. From the rotation angle of the rotor, the encoder outputs an information about the movement of the conveyer apparatus 10 to the control unit 20.

Figure 9:
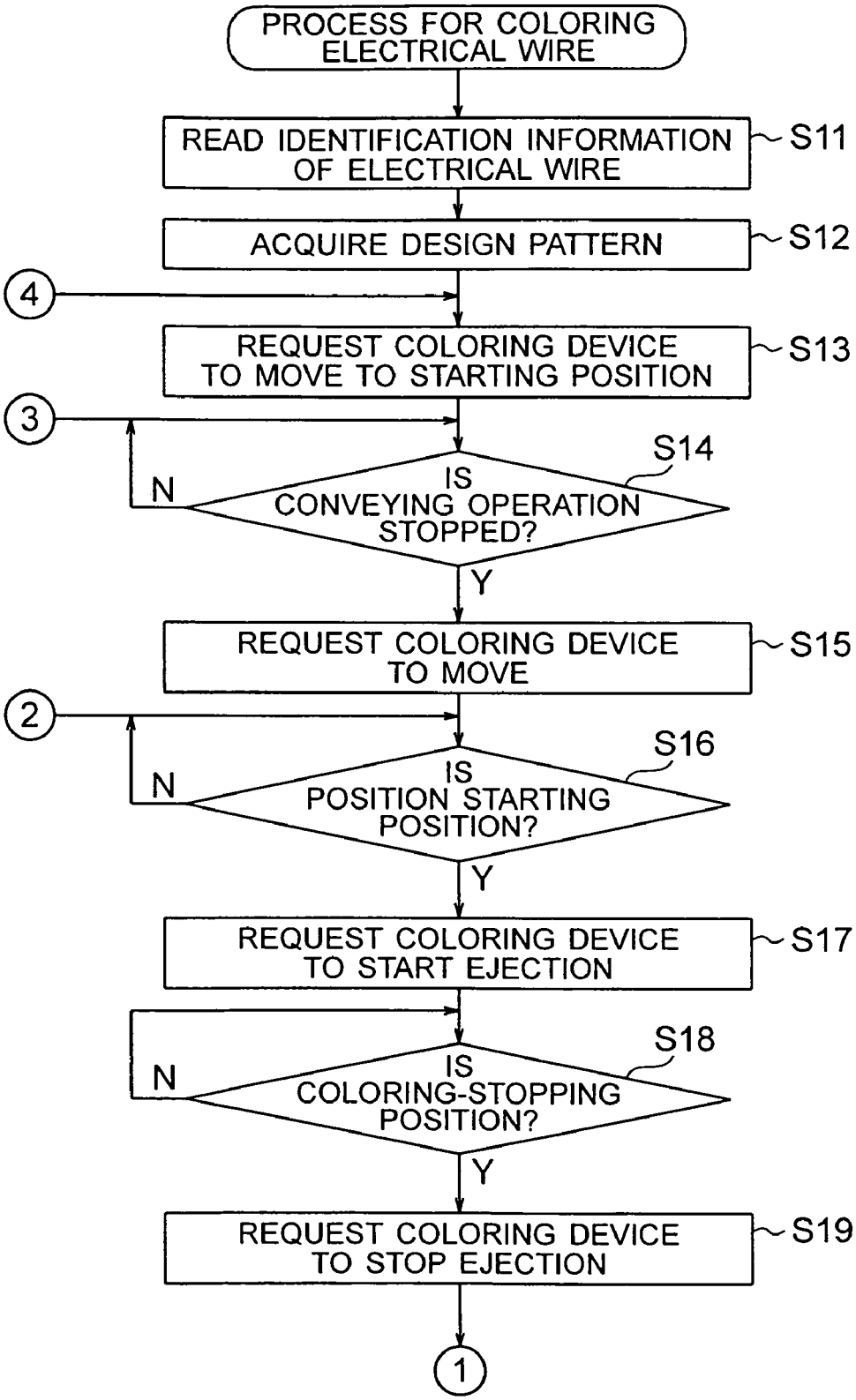
FIG. 9 is a part of a flowchart for processing the coloring of the electrical wire with a CPU of FIG. 4.
Figure 10:
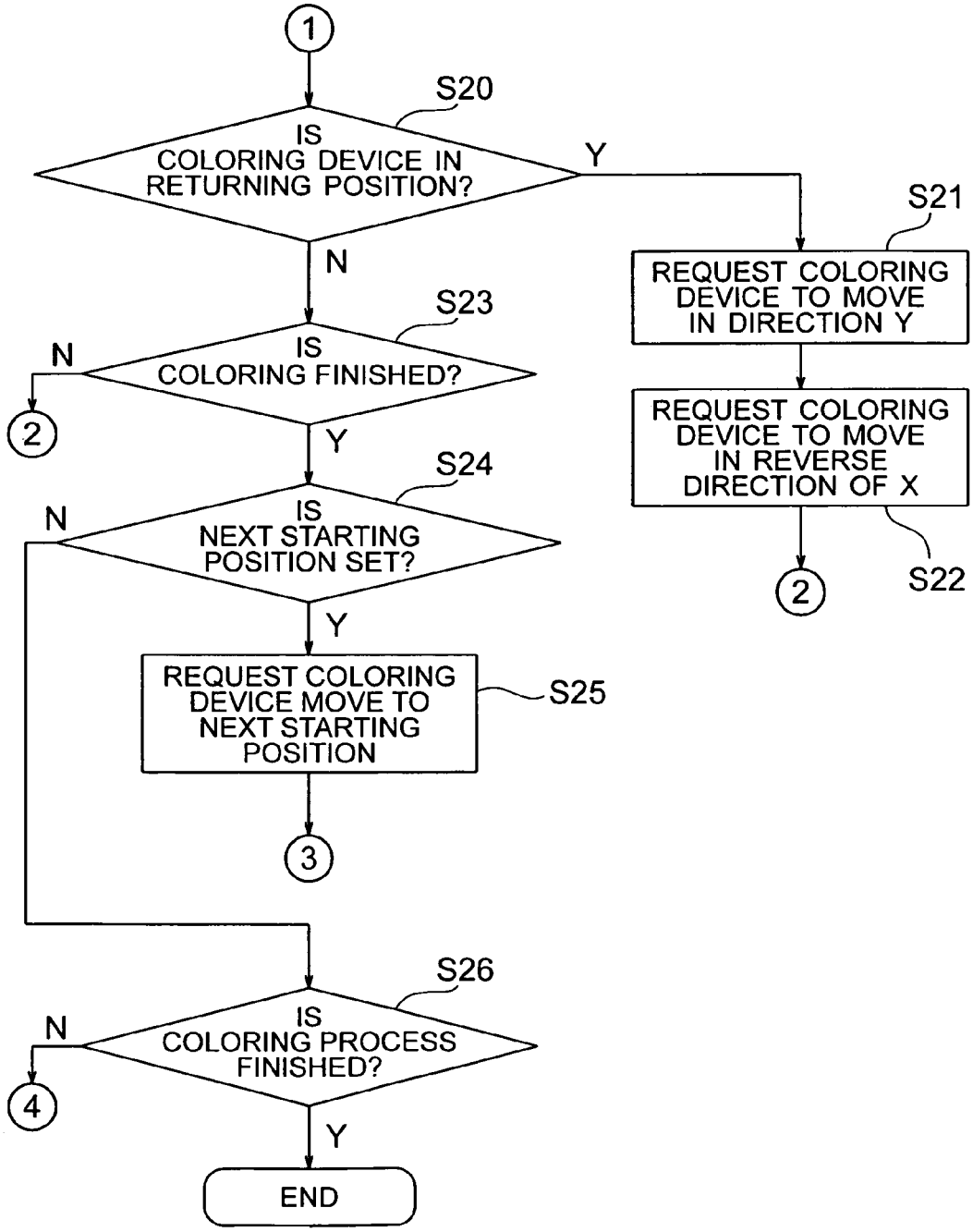
FIG. 10 is a part of the flowchart for processing the coloring of the electrical with the CPU of FIG. 4.

FIGS. 9 and 10 show an example of a flowchart of CPU 21 for coloring the plurality of electrical wires 3 conveyed intermittently with the conveyer apparatus 10.

In order to simplify the explanation, the coloring unit 30 colors the design pattern 6 having three coloring regions 3*b* on the outer surface 3*a* of the electrical wire 3 as shown in FIG. 5, which is intermittently conveyed with the conveyer apparatus 10. The number of passing over the electrical wire 3 with each coloring device 13 for the respective coloring region 3*b* depends on the width of the coloring region 3*b*.

The ROM 22 stores the information about the design pattern 6 of identification data of the electrical wires 3, coloring data about the coloring regions 3*b*, a coloring order, and the colors, starting position data of L0-L4 of FIG. 4, returning position data, a width of the electrical wire 3, starting position data of coloring, stopping position data of coloring. The ROM 22 stores the information about the design patterns of the part numbers of the electrical wires 3.

At step 11, an identification information about the electrical wire 3 is read by a barcode reader (not shown) and inputted into the RAM 23 by a worker.

At step 12, a design pattern responsive to the identification information is acquired from the plurality of design patterns and is stored in the RAM 23.

At step S13, the driver device 24 drives the coloring device 13, which is responsive to a color data of the selected design pattern, to a starting position by driving the first and second sliding devices 14 and 15.

At step S14, it is judged whether the conveying operation is stopped or not, based on the information from the transfer sensor 60. The judgment can be made also with the arrangement of a connection or integration of the conveyer apparatus 10 to the control unit 20.

If it is judged that the conveying operation is not stopped (N at S14), the procedure is repeated until quiescence. When the conveyer apparatus 10 is in quiescence, at step S15, the coloring device 13 is moved to the returning position with a prescribed speed by the first and second sliding devices 14 and 15.

At step S16, the position of the coloring device 13 moved is judged whether the starting position or not. If the judgment is N, the procedure is repeated until the coloring device 13 reaches to the starting position.

At step S17, the driver device 24 requests the coloring device to start the ejection of the coloring material.

At step S18, it is judged whether the position of the coloring device 13 is in a stopping position or not based on a comparison of the position information from the driver device 24 with the coloring-stopping position of the design pattern information. When the judgement is N, the procedure is repeated until reaching to the stopping position. When the judgment is Y, the processing is forwarded to step S19.

At step S19, the driver device 24 requests the coloring device 13 to stop the ejection of the coloring material. The process is forwarded to step S20 of FIG. 10. A detection of the coloring-stopping position is, for example, determined with a comparison between a time from start and a threshold value determined from the prescribed speed of the coloring device 13.

At step S20, the coloring device 13 is judged to be positioned at the returning position or not, based on the information of the completion of movement thereof.

At step S21, the driver device 24 requests the first sliding device 14 to move the coloring device 13 by a prescribed distance along the direction Y of FIG. 4 to another returning position.

At step S22, the driver device 24 requests the second sliding device 15 to move the coloring device 13 to another stopping position with the prescribed speed. The same procedures are repeated as shown in FIG. 9.

When the position of the coloring device 13 is not on the returning position at step S20, it is judged at step S23 that the coloring of the whole coloring regions 3*b* of the electrical wire 3 is completed or not. When the completion of the coloring is not achieved, the process returns to step S14 and repeats the following processes. When it is judged that the coloring is completed, the process forwards to step S24.

At step S24, it is judged whether a next starting position is set or not, based on the design pattern information stored in the RAM 23. When the next starting position is set at step S24, the coloring device 13 is moved to the next starting position with the first and second sliding devices 14, 15 and is repeatedly operated in accord with the flowchart of FIG. 9.

When the next starting position is not set at step S24 (N at step S24), it is judged at step S26 whether the coloring is finished or not. When the coloring is not finished yet, the process is returned to S13 of FIG. 9 and forwarded to the following process. When it is judged that the coloring is completed, the process ends.

FIG. 4 illustrates an operation of the coloring apparatus 1 of the electrical wire 3 with the process described above.

The coloring apparatus 1 reads in the part number of the electrical wire 3 and selects the corresponding design pattern 6, which has the three coloring regions 3*b* shown in FIG. 5 of the embodiment. The starting, returning, and stopping positions for coloring a first coloring region 3*b* are denoted as L2, L0, and L3 respectively. The starting, returning, and stopping positions for coloring a second coloring region 3*b* are denoted as L3, L1, and L4 respectively. The starting, returning, and stopping positions for coloring a third coloring region 3*b* are denoted as L4, blank, and L1 respectively.

The coloring device 13 is moved to the starting position ST1 (L2) of the first coloring region 3*b*. When the quiescence of the conveyer apparatus 10 is confirmed, the coloring device 13 ejects the coloring material to three of the electrical wires 3 until reaching to the returning position L0. The ejection of the coloring material to each electrical wire 3 is achieved with the manner depicted in FIG. 8. The ejection is only carried out when the ejected coloring material is in the adhering region E. When the coloring device 13 reaches to the returning position L0, the coloring device 13 is shifted in the direction Y with a prescribed distance and returned to the stopping position END (L3) while ejecting the coloring material to the three electrical wires 3. The resulting colored regions thus become wider than the width of the first coloring.

When the coloring device 13 reaches to the stopping position END, the coloring device 13 is shifted in the direction Y by a prescribed distance and the plurality of the electrical wires 3 are moved in the conveyer direction F by a prescribed distance L. The coloring device 13 is thus moved to a second staring position ST2 for coloring the second coloring region 3*b* responsive to the design pattern information. The same process as the first coloring region 3*b* is carried out on the second coloring region 3*b*.

When the coloring device 13 reaches to a second stopping position END, the coloring device 13 is shifted in the direction Y by the prescribed distance and the plurality of the electrical wires 3 are moved in the conveyer direction F by the prescribed distance L. The coloring device 13 is thus moved to a third staring position ST3 for coloring the third coloring region 3*b* responsive to the design pattern information. The same process as the first coloring region 3*b* is carried out on the third coloring region 3*b*. The coloring devices 13 thereby form the design pattern 6 of the three coloring regions 3*b* on the whole outer surfaces 3*a* of the electrical wires 3. The coloring devices 13 are again returned to the starting position ST1 to color a next group of the electrical wires 3.

Each coloring device 13 ejects the respective coloring material when the coloring device 13 passes over the electrical wire 3. FIG. 6 shows the direction M of movement of the coloring devices 13 intersecting the longitudinal direction A of the electrical wire 3. The coloring devices 13 only pass over the electrical wires 3 and a moving range of the coloring devices 13 is small so that the coloring devices 13 and the coloring unit 30 can be smaller and occupy smaller space in a factory. In the embodiment of the present invention, the coloring devices 13 color the whole outer surfaces 3*a* of the electrical wires 3 so that the electrical wires 3 are easily identified with eyes and have better designs.

In the embodiment, the coloring devices 13 color step-by-step the coloring regions 3*b* of the plurality of the electrical wires 3 arranged parallel to each other with a constant speed so that an irregular coloring is avoided.

In the embodiment, the coloring devices 13 are moved relatively with respect to the electrical wires 3 for coloring the coloring region 3*b* with one color when the conveyer apparatus 10 is quiescence. After coloring the first coloring region 3*b*, the next coloring region 3*b* is colored by moving the plurality of the electrical wires 3 by the distance L. The movement of the coloring devices 13 is synchronized with the conveying operation of the electrical wires 3 so that the coloring process is capable of forming the design pattern 6 on the outer surfaces 3*a* of the electrical wires 3 without affecting the other processes.

In the embodiment, the ejection of the coloring material 7 is limited within the adhering region E so that the coloring material 7 can be saved.

The coloring apparatus 1 has the holders 11 for holding the electrical wires 3 so that the electrical wires 3 already cut can also be colored with the design pattern 6.

Figure 11:
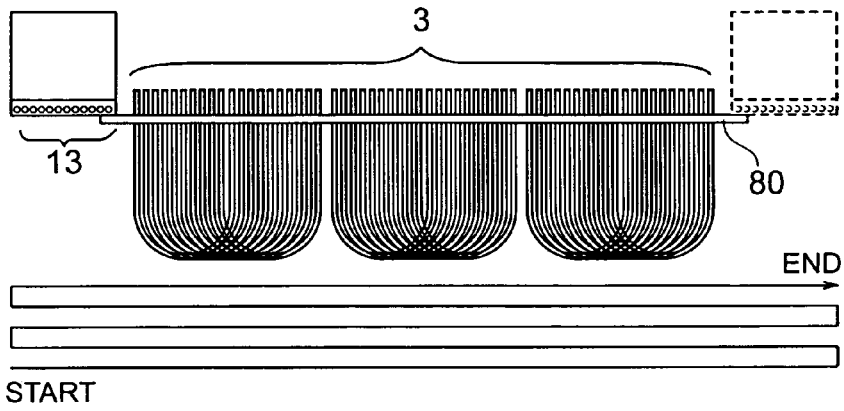
FIG. 11 shows the coloring of a plurality of the electrical wires.

The embodiment shows the intermittent movement of the electrical wires 3 after each coloring operation. The present invention is not limited thereto. As shown in FIG. 11, a plurality of electrical wires 3 locked with a clamping rod 80 are adhered with the coloring material 7 by repeatedly passing the coloring devices 13 over the electrical wires 3 with the highest speed of an actuator. The electrical wires 7 are thus effectively colored with the design pattern.

The embodiment shows that the coloring devices 13 are moved against the electrical wires 3, but other relative movements are also possible, for example, the electrical wires 3 are moved against the coloring devices 13, or both the electrical wires 3 and the coloring devices 13 can be moved each other.

Figure 12:
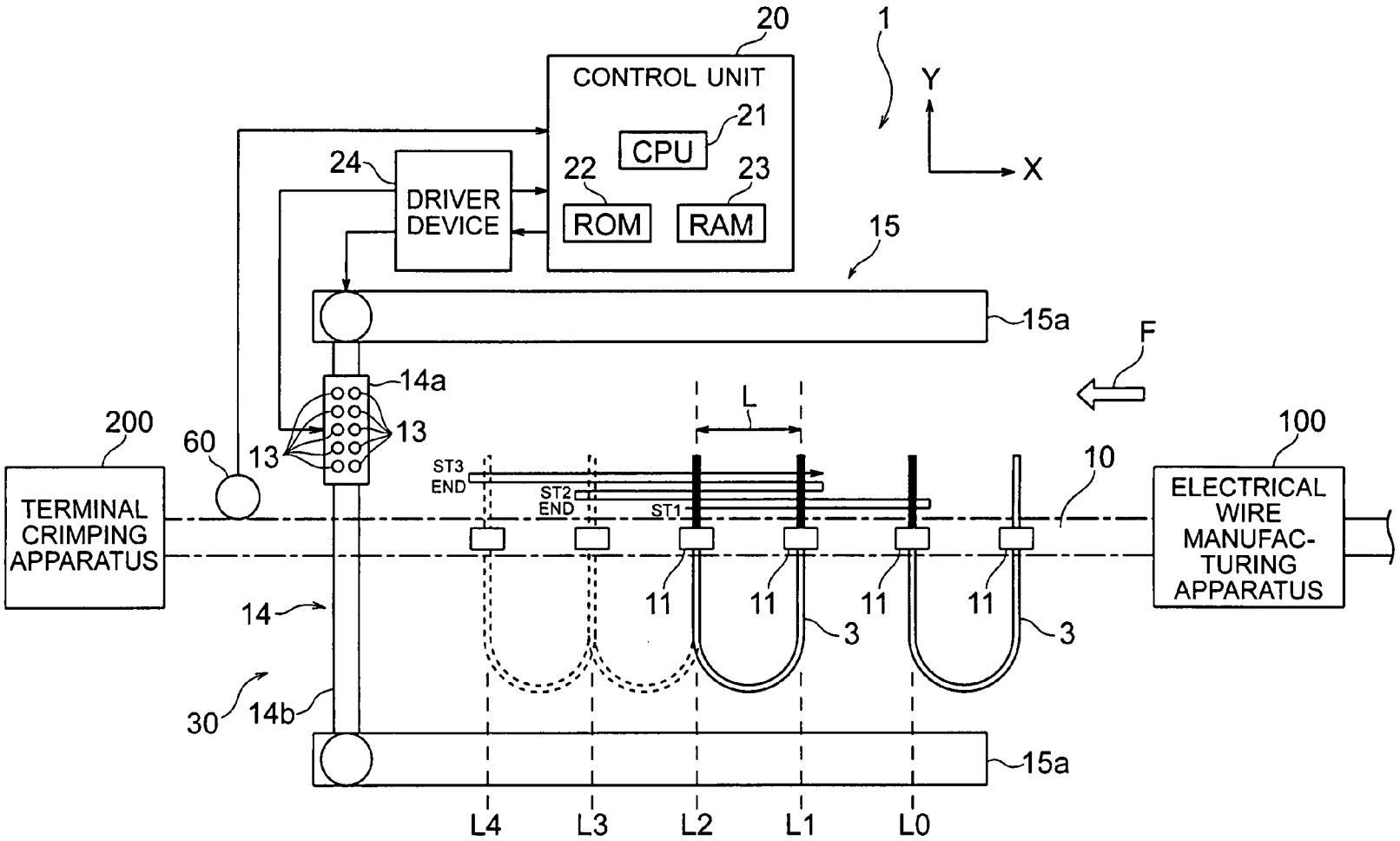
FIG. 12 is another configuration of the coloring apparatus of FIG. 4.

The embodiment shows that the coloring devices 13 are arranged parallel to the conveyer direction F as shown in FIG. 4, but the coloring devices 13 can be arranged perpendicularly to the conveyer direction F as shown in FIG. 12. The coloring devices 13 are arranged in at least one line (two in FIG. 12).

EXAMPLE 2

In the first embodiment, each coloring device 13 colors the respective coloring region 3*b* of the electrical wire 3. A second embodiment of a coloring apparatus achieves an operation of a plurality of coloring nozzles. In the description of the second embodiment, like portions are provided with like reference signs.

Figure 13:
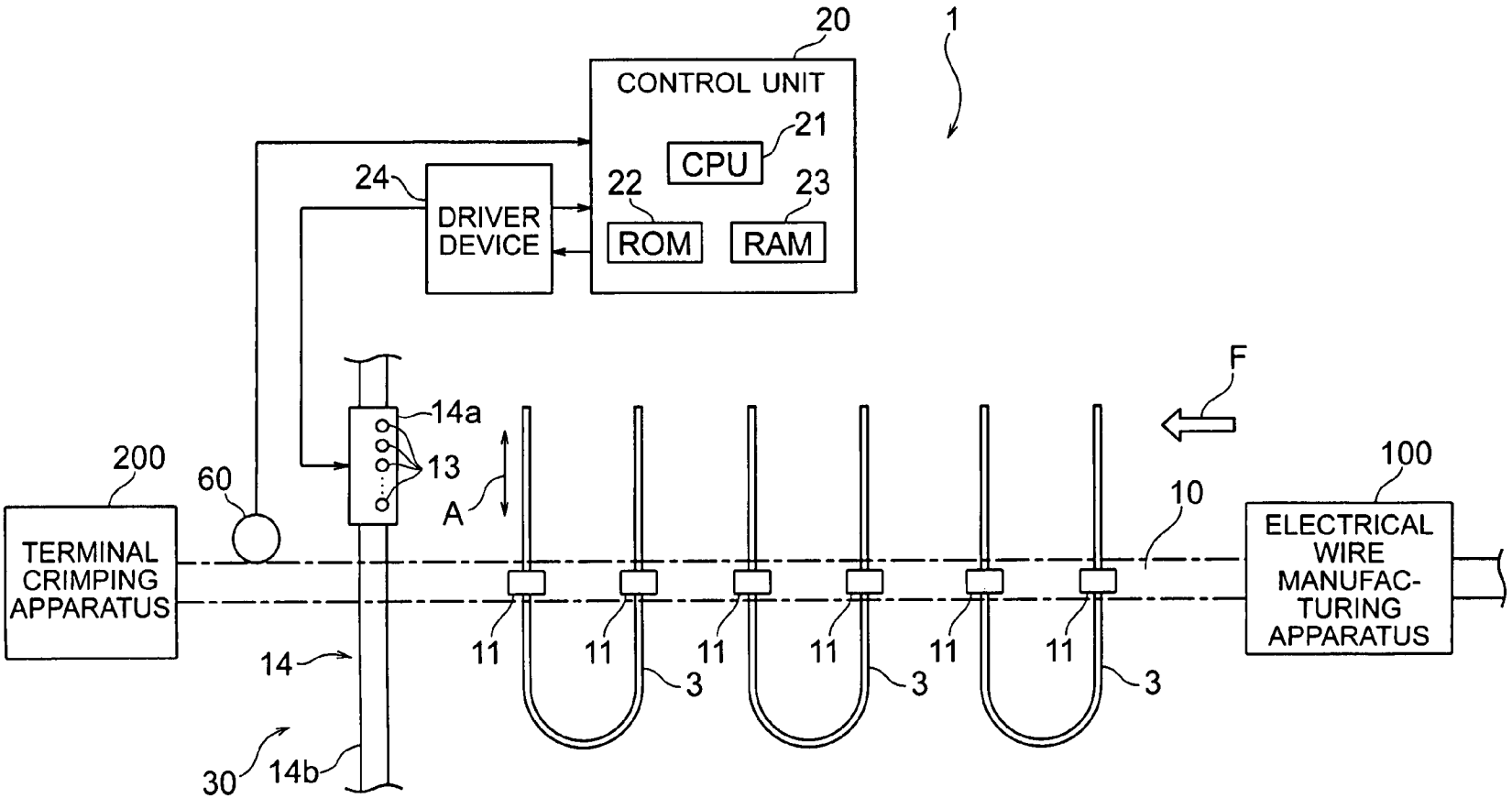
FIG. 13 is a configuration of a second embodiment of a coloring apparatus of the present invention.

Referring to FIG. 13, an apparatus 1 for coloring electrical wires 3, hereafter coloring apparatus, includes a control unit 20, a coloring unit 30, a driver device 24 for driving the coloring unit 30, and a transfer sensor 60.

The control unit 20 has a central processing unit (CPU) 21 for achieving several controls or processes responsive to a prescribed program, a ROM (Read-only Memory) 22 for storing the program achieved with the CPU 21, and a RAM (Random Access Memory) 23 for storing several data and providing a working area for the CPU 21. The ROM 22 stores a coloring control device and a moving control device as programs processed with the CPU 21, and an information about a plurality of design patterns responsive to colors and sizes of the electrical wires 3. The design pattern information includes a coloring region 3*b*, a coloring material, and an ejecting-starting position of the coloring region 3*b*.

The driver device 24 is connected to the control unit 20 and the coloring unit 30, and controls ejection and movement of coloring devices 13, and outputs a positioning information, for example, a value of a counter, responsive to the position of the coloring device 13 moving, to the control unit 20.

The coloring unit 30 includes the plurality of the coloring devices 13 corresponding to the colors of the coloring materials 7, a case 14*a* for receiving the coloring devices 13, and a sliding device 14 (moving device) slidable along a longitudinal direction A of the electrical wires 3 of FIG. 13.

The plurality of the coloring devices 13 are arranged along the longitudinal direction A of the electrical wires 3 and may include a plurality of lines along a conveyer direction F.

Figure 14:
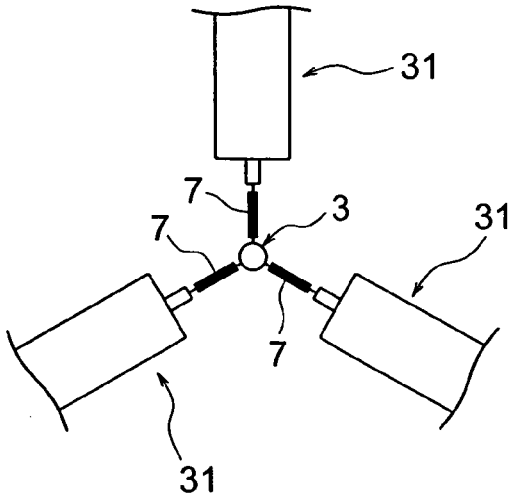
FIG. 14 illustrates a configuration of coloring devices and an electrical wire of the second embodiment.

Each of the coloring devices 13 has three coloring nozzles 31, three coloring material suppliers 32 (not shown), and three pressurized gas suppliers 33 (not shown). In the second embodiment of the present invention, the three coloring nozzles 31 are arranged around the electrical wire 3 as shown in FIG. 14, but any number of the coloring nozzles 31 is possible.

The three coloring nozzles 31 are radially disposed around the electrical wire 3 with an equal angle. The electrical wire 3 is colored with ejection of the coloring materials 7 from an upper, a left-lower, and a right-lower nozzles 31 so that a whole outer surface 3*a* of the electrical wire 3 is colored. The arrangement of the coloring nozzles 31 of FIG. 14 is capable of coloring the electrical wire 3 having a large diameter.

The coloring material suppliers 32 receive the liquid coloring materials corresponding to the three coloring nozzles 31 and supply the coloring materials to the conduits 36 of the corresponding coloring nozzles 31.

Each pressurized gas supplier 33 supplies the pressurized gas to the coloring material supplier 32 so that each valve 44 is detached from an end 37*a* of a first nozzle member 37 and the coloring material in a passage 39 is ejected from a second nozzle member 50.

Each coloring device 13 can vary the pressure of the pressurized gas supplier 33, a nozzle diameter of the coloring nozzle 31, a flowing speed of the coloring material in the nozzle, a distance between the coloring nozzle 31 and the electrical wire 3, and a viscosity of the coloring material so that the a width of the coloring region 3*b* and an encirclement of the coloring material on the electrical wire 3 can be controlled for effectively forming the desired design pattern.

The sliding device 14 is connected to the driver device 24 which controls a driving motor. The driving motor thereby drives the case 14*a* along a rectangular-shaped rail 14*b* and moves the case 14*a* to a prescribed position. The control unit 20 controls the position of the case 14*a* in the vertical (the longitudinal direction A of the electrical wire 3) of FIG. 13. The sliding device 14 holds the coloring nozzles 31 of the coloring devices 13 perpendicularly to the electrical wires 3 and moves vertically in FIG. 13 the coloring nozzles 31.

The coloring devices 13 are moved on the rail 14*b* and eject the coloring materials 7 at right angle to the coloring regions 3*b* of the outer surfaces 3*a* of the electrical wires 3.

The control unit 20 selects one coloring device 13 responsive to a coloring color of the coloring regions 3*b*, and requests the driver device 24 to move the coloring device 13 in the longitudinal direction A of the electrical wire 3 of FIG. 13. The control unit 20 then requests the coloring device 13 to color the coloring region 3*b* with assist of the sliding device 14. In this embodiment, the driver device 24 is utilized but the control unit 20 can directly control the coloring devices 13 and the sliding device 14 without the driver device 24.

Figure 15:
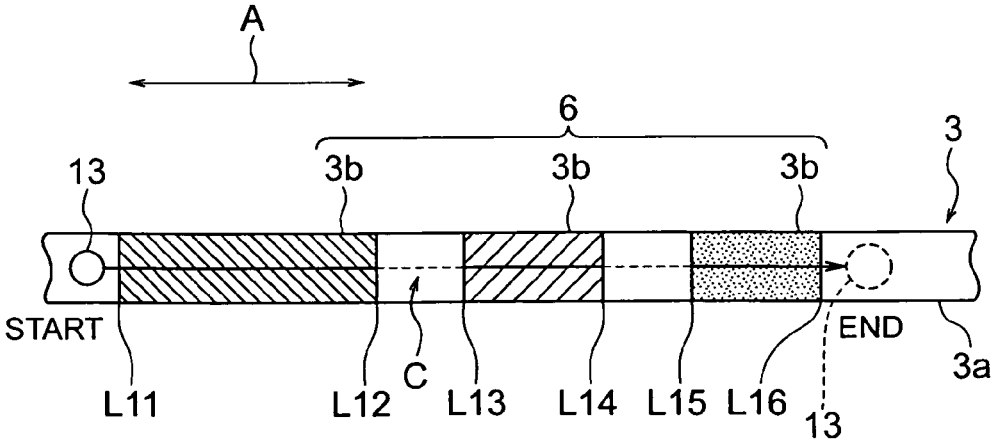
FIG. 15 illustrates a movement of the coloring device corresponding to a design pattern of the second embodiment.
Figure 16:
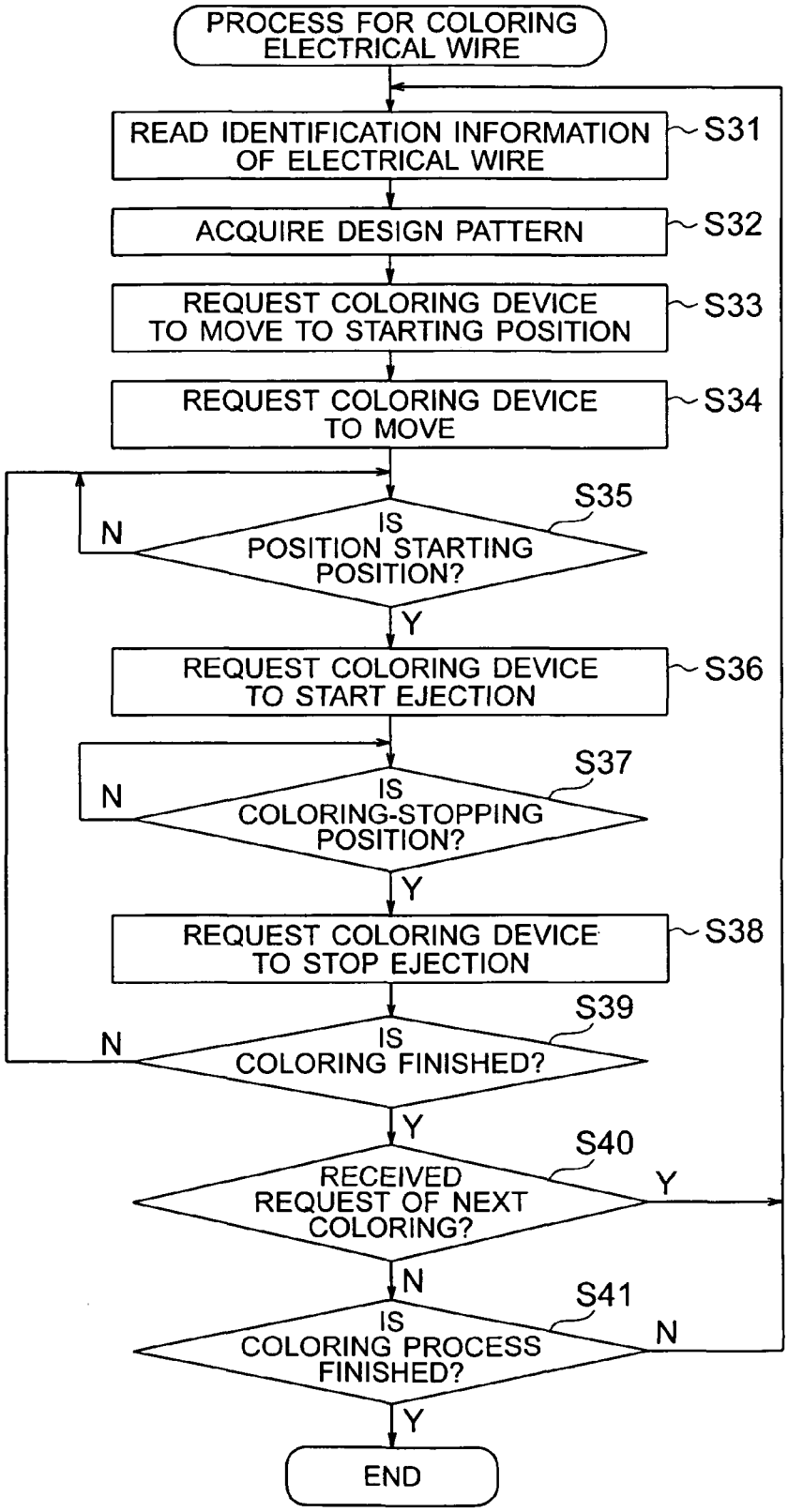
FIG. 16 is a flowchart for processing the coloring of the electrical wire with a CPU of FIG. 13.

When a design pattern 6 of FIG. 15 is formed on the outer surface 3*a* of the fixed electrical wire 3, the coloring devices 13 are moved from START to END along solid lines and dotted lines in a direction C. When the coloring devices 13 each face to the responsive coloring region 3*b* of the electrical wire 3, the respective coloring device 13 ejects the coloring material 7 onto the electrical wire 3 through the coloring nozzle 31 to form the respective coloring region 3*b*.

A process executed with the CPU 21 of the control unit 20 for forming the design pattern 6, shown in FIG. 15, on the outer surface 3*a* of the fixed electrical wire 3 is explained.

The ROM 22 stores the information about the design pattern of an identification data of the electrical wire 3, coloring data about the coloring regions 3*b*, a coloring order, and the colors, starting position data, stopping position data, a width of the electrical wire 3, starting position data of coloring, and stopping position data of coloring.

At step S31, an identification information about the electrical wire 3 is read by a barcode reader (not shown) and inputted into the RAM 23 by a worker.

At step S32, a design pattern responsive to the identification information is acquired from the plurality of design patterns and stored into the RAM 23.

At step S33, the driver device 24 requests one coloring device 13, which corresponds to a color data of the selected design pattern, to move to a starting position (START in FIG. 15). Since the coloring unit 30 of the second embodiment has the plurality of the coloring devices 13, a reference for movement of the coloring devices 13 is provided to one of them.

At step S34, the driver device 24 drives the sliding device 14 to move the coloring device 13 to the starting position.

At step S35, it is judged that the position of the coloring device 13 moved is the starting position or not. If the judgment is N, the procedure is repeated until the respective coloring device 13 reaches to the starting position.

At step S36, the driver device 24 requests the coloring device 13 to start ejection of the coloring material.

At step S37, it is judged whether the position of the coloring device 13 is in a stopping position or not, based on the position information from the driver device 24 and the coloring-stopping position of the design pattern information. When the judgment is N, the procedure is repeated until reaching to the stopping position. When the judgment is Y, the processing is forwarded to step S38.

At step S38, the driver device 24 requests the coloring device 13 to stop the ejection of the coloring material. The process is forwarded to step S39 of FIG. 16. A detection of the coloring-stopping position is, for example, determined with a comparison between a time from start and a threshold value determined from the prescribed speed of the coloring device 13.

At step S39, it is judged that the step-by-step coloring of the whole coloring regions 3*b* is completed or not, based on the decision that the coloring device 13 reaches the stopping position END. When the coloring is not finished (N at step S39), the process returns to step S35 and is repeated. When the coloring is finished, the process is forwarded to step S40.

At step S40, it is judged whether the coloring of the next electrical wire 3 is requested or not. If it is Y, the process returns to step S31 and is repeated. If it is N, the process is forwarded to step S41.

At step S41, it is judged whether it is required to be finished or not. If it is N, the process returns to S31 and repeats the following processes to color the next electrical wire 3. If it is Y, the process ends.

An operation of the second embodiment of the coloring apparatus 1 is explained by referring to FIG. 15.

The coloring apparatus 1 identifies a part number of the electrical wire 3 to be colored and selects the corresponding design pattern for three coloring regions 3*b*. Starting positions of coloring L11, L13, L15 and stopping position thereof L12, L14, L16 are set for the respective coloring regions 3*b* in the coloring apparatus 1.

When the coloring device 13 comes to the starting position L11 of a first coloring region 3*b*, the coloring device 13 ejects the coloring material 7 to the outer surface 3*a* of the electrical wire 3 and stops the ejection at the stopping position L12.

When the coloring device 13 comes to the starting position L13 of a second coloring region 3*b*, the coloring device 13 ejects the coloring material 7 to the outer surface 3*a* of the electrical wire 3 and stops the ejection at the stopping position L14. The coloring of a third coloring region 3*b* is started at L15 and stopped at L16.

The whole outer surface 3*a* of each coloring region 3*b* of the electrical wire 3 is thus colored to form the design pattern 6. After the coloring process is finished, the conveyer apparatus 10 moves the electrical wires 3 with the holders 11 for coloring the next electrical wire 3.

In the second embodiment of the coloring apparatus 1, the plurality of the coloring devices 13 are arranged around the electrical wire 3 and moved along the longitudinal direction thereof 3 for coloring the whole outer surfaces 3*a* of the three coloring regions 3*b*. The second embodiment utilizes only one sliding device 14 for moving the coloring devices 13 so that the coloring apparatus 1 is simplified and the cost thereof is reduced. The coloring of the whole outer surfaces 3*a* of the electrical wire 3 increases visibility and design. The simple coloring of the design pattern 6 to the electrical wire 3 reduces the stock of various colors of the electrical wires 3 and saves the space of the factory.

In the above embodiments, the coloring of the electrical wires 3 is controlled with the relative position between the coloring devices 13 and the electrical wires 3.

EXAMPLE 3

Figure 17:
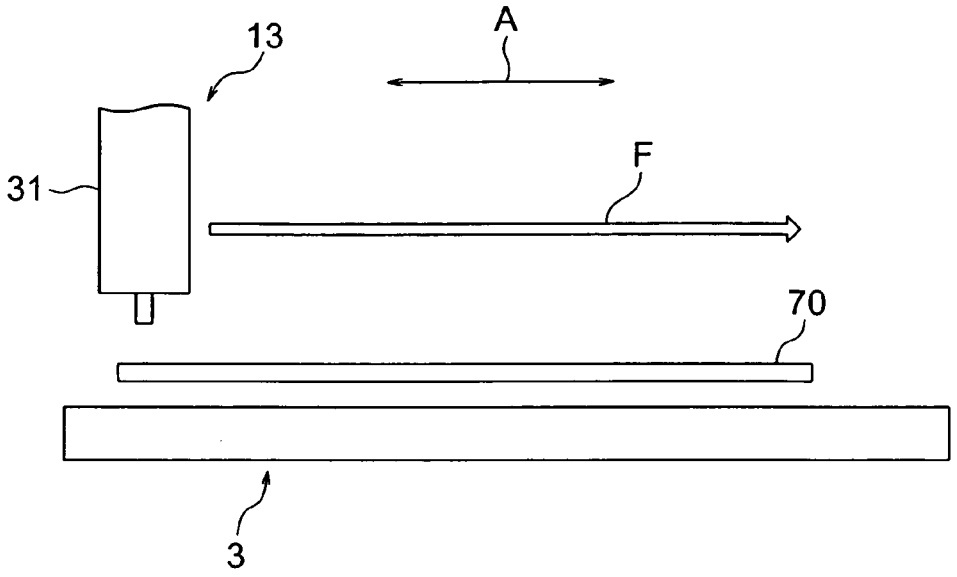
FIG. 17 illustrates a configuration of a coloring device, an electrical wire, and a mask of a third embodiment.

FIG. 17 shows a third embodiment of an apparatus for coloring an electrical wire 1, hereafter coloring apparatus. Like portions are provided with like reference signs.

The coloring apparatus 1 has a control unit 20, a coloring unit 30, a driver device 24 for driving the coloring unit 30, a transfer sensor 60, similar to the second embodiment of FIG. 13 and a mask 70.

Figure 18:
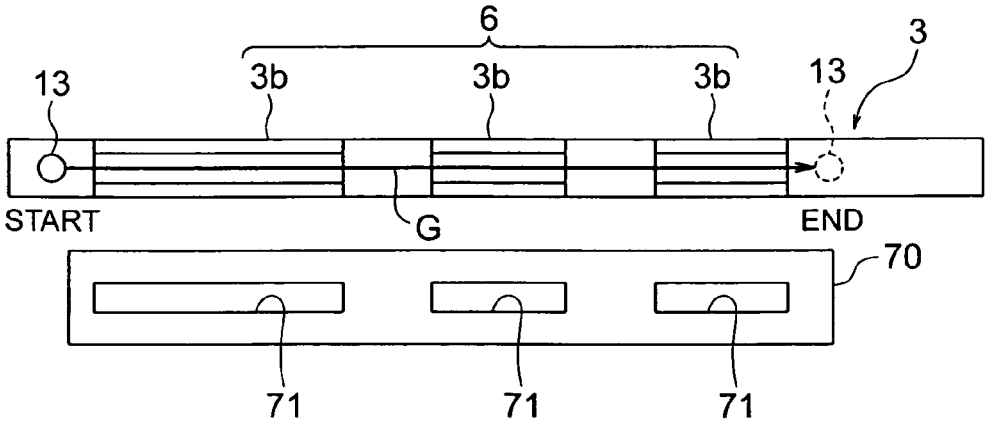
FIG. 18 shows a design pattern and the mask for forming the design pattern.

The mask 70 is formed from a metal or synthetic resin and has a flat shape. As shown in FIG. 18, the mask 70 is larger than the design pattern 6 of the electrical wire 3 and disposed between a coloring nozzle 31 and an outer surface 3*a* of the electrical wire 3 and has a gap between the mask 70 and the outer surface 3*a*.

If one utilizes a plurality of the coloring nozzles 31 as in the second embodiment, the mask 70 is replaced with a sealing element.

The mask 70 has a plurality of slots 70, three slots in FIG. 18. When the coloring material 7 is ejected from the coloring nozzle 31, the coloring material 7 partly passes through the slots 71 and adheres to the outer surface 3*a* of the electrical wire 3 and partly sticks on a surface of the mask 70. In this embodiment, a width of the slots 71 is smaller than that of the electrical diameter 3 but can be larger than that thereof.

When the coloring device 13 colors the coloring regions 3*b* of the electrical wire 3, the coloring nozzle 31 is simply moved from a starting position START to a stopping position END along a direction F of FIG. 17 while ejecting the coloring material 7 to the outer surface 3*a* of the electrical wire 3 along a direction G. The continuous ejection of the coloring material 7 simplifies the coloring apparatus 1 and increases the coloring rate.

An operation of the third embodiment of the coloring apparatus is explained by referring to FIG. 18.

The coloring apparatus 1 selects a design pattern corresponding to a part number of the electrical wire to be colored. When the design pattern has a single color, the coloring device 13 corresponding to the color continuously ejects the coloring material 7 toward the mask 70 from the starting position START to the stopping position END. The coloring material 7 passed through the slots 71 adheres and encircles the electrical wire 3*a* and colors the coloring regions 3*b*.

When the coloring regions 3*b* are colored with the different colors, the plurality of the coloring devices 13 are controlled with the control unit 20 similar to the second embodiment of FIG. 15, wherein the starting and stopping positions are determined.

The coloring of the whole outer surface 3*a* of the electrical wire 3 increases visibility and design. The simple coloring of the design pattern 6 to the electrical wire 3 reduces the stock of various colors of the electrical wires 3 and saves the space of the factory.

The coloring nozzles 31 of the coloring devices 13 have a circular section in the above embodiments. It is appreciated that the coloring nozzle 31 has an oval shape having a main axis in a direction of the width of the electrical wire 3 and the same length as the width thereof. The coloring nozzle 31 having the oval section and the same size as the width of the electrical wire 3 can form the belt-shaped design pattern 6 all around the outer surface 3*a* of the electrical wire 3 and provide also the improved visibility compared to the conventional coloring, which colors a part of the outer surface 3*a* of the electrical wire 3. The simple coloring of the design pattern 6 to the electrical wire 3 reduces the stock of various colors of the electrical wires 3 and saves the space of the factory.

Industrial Applicability

The present invention provides an apparatus for coloring (coloring apparatus) an electrical wire with a belt-shaped design pattern. The design pattern is formed on a whole outer surface of the electrical wire so that the electrical wire is easily identified from any directions.

The coloring apparatus is moved in a direction perpendicular to a longitudinal direction of the electrical wire so that the coloring apparatus can be made smaller.

The coloring apparatus can easily form the design pattern so that it is not necessary to stock a variety of colors of the electrical wires resulting to reduction of space.

The coloring apparatus can simultaneously color the plurality of the electrical wires with a constant speed so that the electrical wires are colored uniformly.

The coloring apparatus colors the electrical wires synchronized with a conveyer apparatus so as not to affect other processes.

The coloring apparatus colors the electrical wire only when a coloring device is in an adhering region so that an amount of the coloring material is reduced.

The plurality of the coloring devices arranged radially around the electrical wire can color the whole outer surface of the electrical wire so that the electrical wire can be easily identified from any directions. A movement of the plurality of the coloring devices in a longitudinal direction of the electrical wire can simplify a sliding device.

A wide coloring nozzle provides the coloring of the whole outer surface of the electrical wire so that the electrical wire can be easily identified with the design pattern.

A mask disposed between the coloring device and the electrical wire forms assuredly the design pattern on the electrical wire so that the electrical wire can be easily identified from any directions. The apparatus utilizing the mask is not required to include an ejecting-starting position and stopping position so that the coloring apparatus can be simplified.

The coloring apparatus has a holder for holding a cut electrical wire and coloring the cut electrical wire so that it is not necessary to wait drying of the coloring material.

The invention claimed is:

1. A method of coloring outer surfaces of a plurality of electrical wires comprising the steps of:

cutting an electrical wire into a plurality of individual electrical wires, each electric wire having a prescribed length and attaching each individual electrical wire separately to a conveyor apparatus;

ejecting a liquid coloring material to the outer surface of each of respective electrical wires;

coloring the outer surface of a plurality of coloring regions thereof responsive to a belt-shaped design pattern with a coloring device;

moving intermittently each of the individual electrical wires in a direction perpendicular to the longitudinal direction of the ends of the plurality of the electrical wires with the conveyer apparatus, and moving the coloring device to eject the coloring material in a direction perpendicular to a longitudinal direction of the ends of the electrical wires.

2. The method of coloring outer surfaces of a plurality of electrical wires of claim 1 further comprising the steps of:

before ejecting a liquid coloring material, forming the electrical wires into a U-shape.

3. The method of coloring outer surfaces of a plurality of electrical wires of claim 1, wherein the ejecting is only carried out when the ejected liquid coloring material is in an adhering region.

4. The method of coloring outer surfaces of a plurality of electrical wires of claim 1 further comprising the steps of:

coloring each whole outer surface of a plurality of coloring regions thereof responsive to a belt-shaped design pattern with a plurality of coloring devices.

5. The method of coloring outer surfaces of a plurality of electrical wires of claim 1 further comprising the steps of:

coloring each whole outer surface of a plurality of coloring regions thereof responsive to a belt-shaped design pattern with three coloring devices.

6. The method of coloring outer surfaces of a plurality of electrical wires of claim 1 further comprising the steps of:

coloring each whole outer surface of a plurality of coloring regions thereof responsive to a belt-shaped design pattern with a coloring device having a coloring nozzle which is wider than a width of the electrical wire.

7. The method of coloring outer surfaces of a plurality of electrical wires of claim 1 further comprising the steps of:

disposing a mask between the coloring device and the electrical wire for regulating the coloring material ejected from the coloring device so as to form a design pattern on the outer surface of the electrical wire; and moving a sliding device for moving the coloring device in a longitudinal direction of the electrical wire with respect to the mask.

* * * * *